United States Patent [19]

Lawrie

[11] Patent Number: 5,003,849

[45] Date of Patent: Apr. 2, 1991

[54] ALIGNMENT SLEEVE FOR HAND TOOL HAVING A UNIVERSAL JOINT

[76] Inventor: Warwick W. Lawrie, 116 Westfield Dr., Nashville, Tenn. 37221

[21] Appl. No.: 523,062

[22] Filed: May 14, 1990

[51] Int. Cl.[5] ..... B25B 23/00

[52] U.S. Cl. ..... 81/184; 81/177.75; 403/223; 464/173

[58] Field of Search ..... 81/184, 177.75, 177.7, 81/177.6; 464/173, 136, 115, 119; 403/57, 58, 114, 116, 117, 51, 122, 223, 20, 23

[56] References Cited

U.S. PATENT DOCUMENTS 3,378,286 4/1968 Gottschald ..... 403/51

4,530,261 7/1985 Ventura ..... 81/177.75

*Primary Examiner*—D. S. Meislin

*Attorney, Agent, or Firm*—Rhodes, Coats & Bennett

[57] ABSTRACT

An alignment sleeve for use with an universal joint-type socket wrench which provides for self-alignment of the wrench with the nut or bolt to be turned. The sleeve includes an integral piece of highly resilient rubber molded into a hollow cylindrical shape and sized to fit snugly around the main body of the universal joint. At least one pair of semi-elliptical shaped ribs are molded into the inner surface of the opposed walls of the sleeve and adapted to interlock with the base member of the universal joint. The self-locking ribs eliminate the need for additional securing means such as clamps or adhesive. Thus, the sleeve may be installed and removed without the use of any other tools. In addition, the upper rim of the sleeve is provided with means to prevent pinching of the sleeve between the universal joint and socket where the sleeve is slightly longer than the body of the universal joint to which it is applied. This permits the sleeve to adapt to many different brands of universal joints and provide self-alignment in existing, non-aligning universal joint socket wrenches.

10 Claims, 2 Drawing Sheets

ALIGNMENT SLEEVE FOR HAND TOOL HAVING A UNIVERSAL JOINT

BACKGROUND OF THE INVENTION (1) Field of the Invention

The present invention relates generally to universal joint socket wrenches and, more particularly, to a device for providing self-alignment of the wrench with the nut or bolt to be turned.

(2) Description of the Prior Art

The popularity of the simple universal joint socket wrench is due to its strength, compactness in size, and cost of its basic construction. However, the repeated use of the wrench results in worn mating surfaces of the universal joint. As this condition progresses the socket end of the wrench becomes increasingly difficult to align and attach to a nut or bolt. The problem is due to lateral forces applied to the universal joint by accidentally bumping the socket end against objects surrounding the linear path between the repair person and the nut or bolt to be turned as well as the gravitational pull on the socket.

Some different designs of universal joint type wrenches have provided a means of self-alignment. For example, the following patents related to universal joints employ a spring biasing principle to align the wrench: U.S Pat. No. 1,324,898 issued to Hopcraft; U.S. Pat. No. 1,975,695 issued to Lund; U.S. Pat. No. 2,499,569 issued to Cooley; and U.S. Pat. No. 4,065,941 issued to Aoki.

However, the majority of universal joint designs only provide means for universal movement without a means for self-alignment. Thus, various other approaches to this problem include replacing the worn universal joint with a new one, accepting the problem and living with it, or wrapping a length of electrical tape around the body of the universal joint for added support. While the electrical tape method works, it introduces other problems. For example, the adhesive in the electrical tape attracts dust and dirt, any contact with oil or solvents causes the tape to slowly detach from the universal joint, and the lifetime of the resilience response of the tape is short.

A solution to a somewhat related problem is illustrated in U.S. Pat. No. 4,530,261 issued to Ventura. The Ventura patent discloses a wrench adapted for tightening mine wall support bolts. The wrench includes a resilient, impermeable sleeve which surrounds the universal joint. The sleeve is specially designed with sufficient thickness and a high enough material density to limit the movement of the universal joint. In addition, the sleeve also seals the joint against the infusion of solid and liquid matter. However, there is no recognition by Ventura of the problem of worn mating align and attach to a nut or bolt. Furthermore, the sleeve, as taught by Ventura, is held in place by an outer clamp and can not be readily removed without tools.

Thus, there remains a need for an alignment sleeve for a hand tool having a universal joint which is adapted for quick installation and removal by hand, is self-securing, does not collect dust and dirt, is unaffected by oil or solvents, and retains its resiliency over time.

SUMMARY OF THE INVENTION

The present invention is directed to an alignment sleeve for use with a universal joint-type socket wrench which provides for self-alignment of the wrench with the nut or bolt to be turned. The sleeve comprises an integral piece of highly resilient rubber molded into a hollow cylindrical shape and sized to fit snugly around the main body of the universal joint. At least one pair of semi-elliptical shaped ribs are molded into the inner surface of the opposed walls of the sleeve and adapted to interlock with the base member of the universal joint. The self-locking ribs eliminate the need for additional securing means such as clamps or adhesive. Thus, the sleeve may be installed and removed without the use of any other tools.

In addition, the upper rim of the sleeve is provided with means to prevent pinching of the sleeve between the universal joint and socket where the sleeve is slightly longer than the body of the universal joint to which it is applied. This permits the sleeve to adapt to many different brands of universal joints and provide self-alignment in existing, non-aligning universal joints.

Accordingly, one aspect of the present invention is to provide an alignment device for a hand tool employing a universal joint having a first end for attachment to the drive means of the tool and a second end for attachment to the driven means of the tool. The device includes a resilient, non-metallic sleeve formed into a hollow cylindrical shape and adapted to frictionally contact the outer surfaces of the universal joint to limit the magnitude of movement of the universal joint when the universal joint is subjected to lateral forces below a predetermined value and permit the movement of the universal joint when the universal joint is subjected to lateral forces above a predetermined value and means for limiting the movement of the sleeve with respect to the universal joint.

Another aspect of the present invention is to provide an improvement in an alignment device for a hand tool employing a universal joint having a first end for attachment to the drive means of the tool, a second end for attachment to the driven means of the tool and an intermediate section pivotally attached between the first end and the second end. The device includes a resilient, non-metallic sleeve formed into a hollow cylindrical shape and adapted to frictionally contact the outer surfaces of the universal joint to limit the magnitude of movement of the universal joint when the universal joint is subjected to lateral forces. The improvement includes at least one pair of elliptically shaped ribs adapted for interlocking between the intermediated section and one of the first and the second ends for limiting the movement of the sleeve with respect to the universal joint.

Still another aspect of the present invention is to provide an alignment device for a hand tool employing a universal joint having a first end for attachment to the drive means of the tool and a second end for attachment to the driven means of the tool. The device includes a resilient, non-metallic sleeve formed into a hollow cylindrical shape and adapted to frictionally contact the outer surfaces of the universal joint to limit the magnitude of movement of the universal joint when the universal joint is subjected to lateral forces below a predetermined value and permit the movement of the universal joint when the universal joint is subjected to lateral forces above a predetermined value, at least one pair of elliptically shaped ribs adapted for interlocking between the intermediated section and one of the first and the second ends for limiting the movement of the sleeve with respect to the universal joint, and means for preventing the portion of the sleeve adjacent to the drive means and the first end of the universal joint from being compressed between the drive means and the universal joint.

These and other aspects of the present invention will be more clearly understood after review of the following description of the preferred embodiment of the invention when considered with the drawings.

DESCRIPTION OF THE PREFERRED EMBODIMENTS

In the following description, like references characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
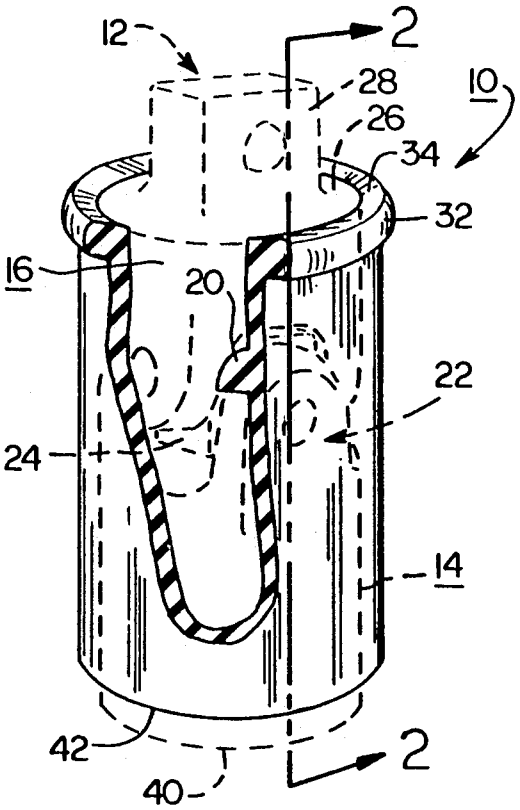
FIG. 1 is a side elevational view of an alignment sleeve constructed according to the present invention installed on a universal joint with certain elements partly or entirely in section to show details of construction.

Referring now to the drawings in general and FIG. 1 in particular, it will be understood that the illustrations are for the purpose of describing a preferred embodiment of the invention and are not intended to limit the invention thereto. As best seen in FIG. 1, an alignment sleeve, generally designated 10, for a hand tool having a universal joint 12 is shown constructed according to the present invention. Sleeve 10 is cylindrically shaped and made of a resilient rubber compound and sized to fit snugly against base 14 and upper section 16 of universal joint 12.

The present invention is formed into a single piece of highly resilient rubber. In the preferred embodiment, the one piece construction is accomplished through a manufacturing process such as rubber injection or compression molding. The alignment sleeve 10 achieves its alignment function by the tendency of the resilient rubber to return to its original cylindrical shape from any other position. Preferably, the resilience strength of the sleeve 10 is chosen to be only sufficient to overcome the gravitational forces encountered by the mass of the universal joint and the socket wrench alone. Other forces which may be applied to the mass will result in the deforming of the sleeve 10 until the force is released, at which point the sleeve 10 returns the universal joint 12 its axially aligned position.X Molded into the inner walls of the sleeve 10 is at least one pair of elliptically shaped ribs 20 only one of which is shown. Ribs 20 are positioned so as to surround the uppermost curved portion of the pivot housing 22 of the lower universal joint section 14. The ribs 20 then continue downward and outward in curves of increasing radii in order to accommodate those universal joints where the design of lower pivotal housing 22 retains a similar shape.

The ribs 20 prevent rotational movement and downward migration of the sleeve 10 along the universal joint 12 during the operation of the universal joint. The nature of the mechanical action of the universal joint 12 normally prevents upward migration of the sleeve 10. For example, when the universal joint 12 is operated the base 14 moves with rotational action only. So in relation to the alignment sleeve 10, the universal joint base 14 does not move.

The mechanical design of these tools is nearly identical among the many different manufacturers. In order to achieve its universal characteristics the universal joint upper section 16 and intermediate section 24 are allowed to move simultaneously in a common plane. The universal joint upper section 16 is provided with additional pivot action from intermediate section 24 resulting in movement in a plane that is perpendicular to the plane shared by universal joint members 16 and 24 together. Accordingly, all relative movement in a universal joint affecting the alignment sleeve 10 is in upper section 16. This movement provides primarily a downward pressure on the sleeve which is checked by the securing ribs 20 resting on lower section 14. Therefore, only one pair of ribs 20 is required to keep the alignment sleeve 10 in place.

Furthermore, due to industry standards ($\frac{1}{4}''$, $\frac{3}{8}''$, $\frac{1}{2}''$ drive etc.) these universal joints also share very similar diametric dimensions which the elasticity of the sleeve 10 conforms to easily. However, the vertical dimensions of these universal joints may vary substantially from one manufacturer to another. As a result a problem may arise should the sleeve extend beyond the upper section shoulder 26 is that the upper rim 30 of the alignment sleeve 10 could, due to elasticity, conform to a diameter less than the diameter of the upper section 16. When a socket (not shown) is introduced onto the receiving member 28 the upper rim 30 of alignment sleeve 10 may become pinched between the socket and the universal joint upper section shoulder 26, thus preventing full attachment of the socket.

In order to prevent this problem from occurring the upper rim 30 of the sleeve 10 is provided with a "roll-out" rim 32 of which a "push pad" 34 is an integral part. The roll-out rim 32 and push pad 34 are designed with larger outer diameters than the alignment sleeve main body 10 outer diameter. The inner diameters of sections 10, 32 and 34 will be the same. The purpose of the larger diameters of the roll-out rim 32 and push pad 34 is to maintain a portion of the upper rim 30 at a greater diameter than the diameter of the upper section shoulder 26. This positioning will, in turn, place a partial area of the push pad 34 at a circumference outside the circumference of the universal joint upper section shoulder 26.

The upper surface of push pad 34 includes a generally flat surface that is angled down toward the center of sleeve 10 at about 30 degrees from horizontal to prevent a force perpendicular to the tangent of the upper rim 30 from occurring which may push the upper rim 30 in a downward and inward direction rather than outward. Thus, when a socket (not shown) is attached to receiving member 28 the lower most outer edge of the socket will first contact the roll-out rim 32 at a circular area within the push pad area 34. As the socket continues downward on receiving member 28, the push pad 34 will be forced outward thus ejecting the roll-out rim 32 from between the mating surfaces of the socket and the universal joint 12.

An additional benefit of the design of the roll-out rim 32 is realized during the removal of the alignment sleeve 10 in such cases where self-alignment of the universal joint 12 is not preferred. Given the environment to which the alignment sleeve 10 will be exposed, it is likely the sleeve 10 will sometimes become coated with a slippery lubricating substance. With these conditions in mind, roll-out rim 32 provides an area to apply a vertical force to the sleeve 10 during removal without it slipping between the remover's fingers. The lower most edge of the sleeve skirt 42 is rounded inwardly to facilitate installation of the sleeve 10 by minimizing the surface area which could become entrapped within the recesses of the universal joint 12.

Figure 2:
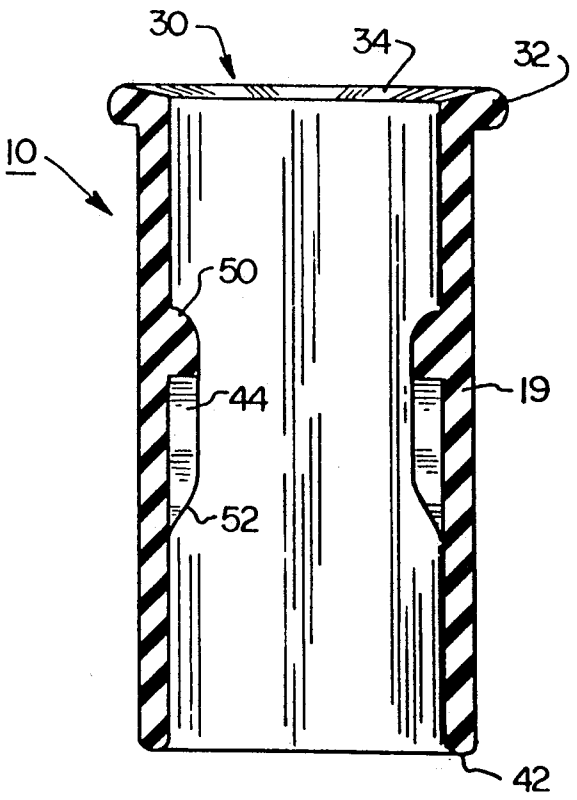
FIG. 2 is a cross-sectional view of the sleeve shown in FIG. 1, taken along lines 2—2.

As best seen in FIG. 2, the upper portion of sleeve 10 includes roll-out rim 32 and push pad 34. The roll-out rim 32 extends outside the plane of the main body of the alignment sleeve 10 and, in turn, places the outer portion of the surface of the push pad 34 outside the same plane to provide the area to apply a vertical force to the sleeve 10 during removal.

Figure 3:
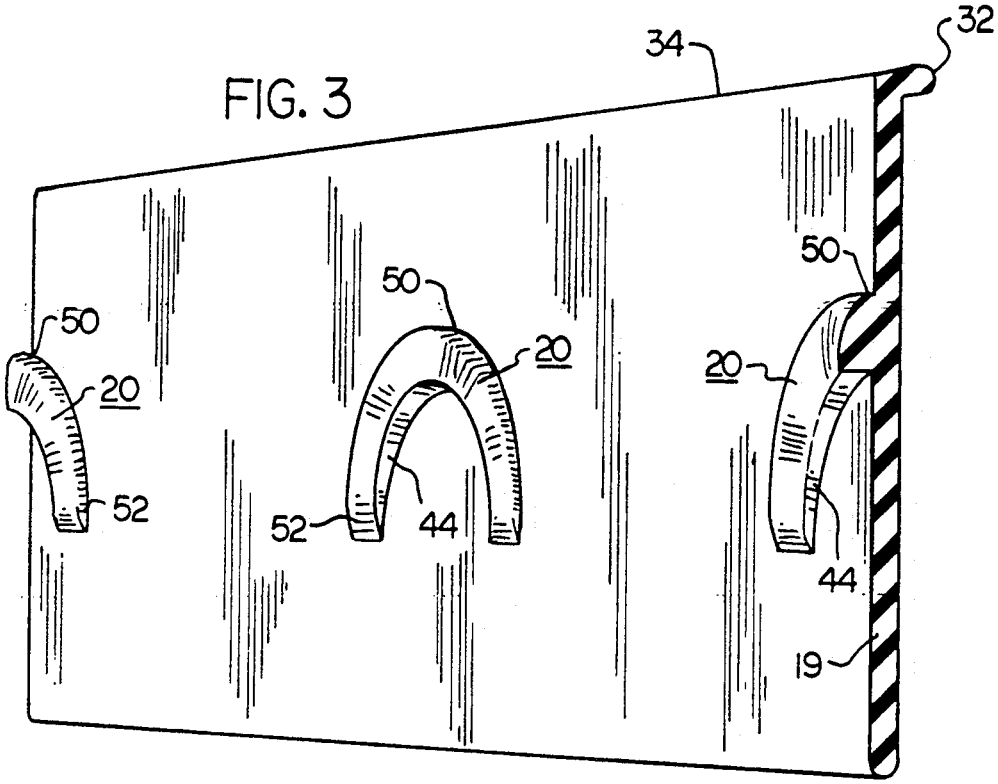
FIG. 3 is a side elevational view of the sleeve shown in FIG. 1 sliced longitudinally and opened to a planar form.

Turning to FIG. 3, ribs 20 are designed with an inner surface 44 that is perpendicular to the main body of the alignment sleeve 10. This design permits the ribs 20 to conform to the intended contact surface on the universal joint 12. The remaining portion of the outer surface of the ribs 20 is designed with a diminishing curvature from the inner surface 44 to the inner surface 46 of the main body of the alignment sleeve 10. There is also a diminishing area of the contact surface 44 at the ends 52 of each of ribs 20. The curved outer areas 50, 52 of the ribs 20 facilitate installation and removal of the alignment sleeve by eliminating unnecessary perpendicular areas within the alignment sleeve 10, thus significantly reducing any binding effect caused by the entrapment of the ribs 20 within the recesses of the universal joint 12 or the upper or lower shoulders of the universal joint 12 during installation and removal of the alignment sleeve 10.

Figure 4:
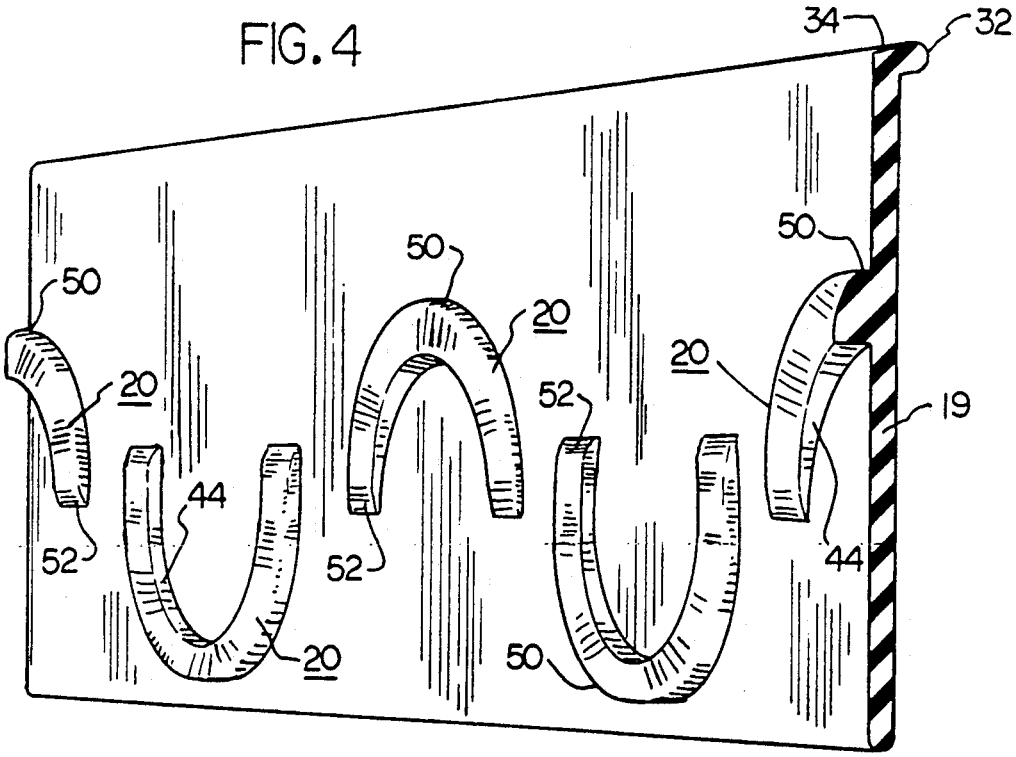
FIG. 4 is a side elevational view of an alternative embodiment of the sleeve shown in FIG. 1 sliced longitudinally and opened to a planar form.

Finally, FIG. 4 is a side elevational view of an alternative embodiment of the sleeve shown in FIG. 1 sliced longitudinally and opened to a planar form. This embodiment includes a second pair of ribs 54, inverted to and midway between the first pair of ribs 20, which interlock with the upper portion of the universal joint 12 in a manner similar to the first pair of ribs 20 and the lower portion of the universal joint 12. As discussed above, the nature of the mechanical action of the universal joint 12 normally prevents upward migration of the sleeve 10. For example, when the universal joint 12 is operated the base 14 moves with rotational action only. So in relation to the alignment sleeve 10, the universal joint base 14 does not move. However, under extreme operating conditions there could be some upward migration of the sleeve 10 which the second pair of ribs 54 will prevent.

In the preferred embodiment, the resilient rubber compound for sleeve 10 is an acrylonitrile-butadiene synthetic polymer having good resistance to oil, heat and chemicals. The compound should have a durometer rating of between about 50 to about 80 Shore with 80 being the higher in resilience.

Certain modifications and improvements will occur to those skilled in the art upon reading of the foregoing description. By way of example, the outer surface of the alignment sleeve could be dimpled or ribbed to provide a better grip for installation and removal. It should be understood that all such modifications and improvements have been deleted herein for the sake of conciseness and readability but are properly within the scope of the following claims.

I claim:

1. In an alignment device for a hand tool employing a universal joint having a first end for attachment to the drive means of said tool, a second end for attachment to the driven means of said tool and an intermediate section pivotally attached between said first end and said second end, said device including a resilient, non-metallic sleeve formed into a hollow cylindrical shape for frictional contact with the outer surfaces of said universal joint to limit the magnitude of movement of said universal joint when said universal joint is subjected to lateral forces, the improvement comprising at least one pair of arcuate shaped ribs for interlocking with said intermediate section and one of said first and said second ends for limiting the movement of said sleeve with respect to said universal joint.

2. The alignment device according to claim 1, wherein the outer peripheral portion of each of said at least one pair of arcuate shaped ribs adjacent of said intermediate section is tapered to facilitate installation and removal of said sleeve upon said universal joint.

3. The alignment device according to claim 1, wherein said at least one pair of ribs are semi-elliptically shaped to permit contact between the inner surface of said sleeve and one of said first and said second ends.

4. An alignment device for a hand tool employing a universal joint having a first end for attachment to the drive means of said tool and a second end for attachment to the driven means of said tool, said device comprising:

(a) a resilient, non-metallic sleeve formed into a hollow cylindrical shape for frictional contact with the outer surfaces of said universal joint to limit the magnitude of movement of said universal joint when said universal joint is subjected to lateral forces below a predetermined value and permit the movement of said universal joint when said universal joint is subjected to lateral forces above a predetermined value; and (b) at least one pair of arcuate shaped ribs for interlocking with said intermediate section and one of said first and said second ends for limiting the movement of said sleeve with respect to said universal joint; and (c) means for preventing the portion of said sleeve adjacent to said driven means and said second end of said universal joint from being compressed between said driven means and said universal joint.

5. The device according to claim 4, further including means for permitting said sleeve to be removed by hand from said universal joint.

6. The device according to claim 5, wherein said means for preventing the portion of said sleeve adjacent to said driven means and said second end of said universal joint from being compressed between said driven means and said universal joint is an outwardly expanded rim located at the end of the sleeve adjacent to said driven means.

7. The device according to claim 6, wherein said outwardly expanded rim located at the end of the sleeve adjacent to said driven means includes a flatted portion adjacent to the outer periphery of said rim, said flatted portion providing a contact area to permit said sleeve to be removed by hand from said universal joint.

8. The device according to claim 5, wherein said means for permitting said sleeve to be removed by hand from said universal joint includes a gripping means molded into the outer surface of said sleeve, said gripping means providing a contact area to permit said sleeve to be removed by hand from said universal joint.

9. The device according to claim 4, wherein the outer peripheral portion of each of said at least one pair of arcuate shaped ribs adjacent of said intermediate section is tapered to facilitate installation and removal of said sleeve upon said universal joint.

10. The alignment device according to claim 4, wherein said at least one pair of ribs are semi-elliptically shaped to permit contact between the inner surface of said sleeve and one of said first and said second ends.

* * * * *